US005974814A

United States Patent [19]

Park et al.

[11] Patent Number: 5,974,814

[45] Date of Patent: Nov. 2, 1999

[54] REFRIGERATOR CAPABLE OF PREVENTING HEAT EXCHANGE BETWEEN AN EVAPORATOR AND OUTSIDE WARM AIR

[75] Inventors: Yong-jong Park, Sungnam; Kyung-hoon Lee; Jun-dong Ji, both of Suwon, all of Rep. of Korea

[73] Assignee: Samsung Electronics Co., Ltd., Suwon, Rep. of Korea

[21] Appl. No.: 09/084,891

[22] Filed: May 28, 1998

[30] Foreign Application Priority Data

Jul. 23, 1997 [KR] Rep. of Korea ..... 97-34353
Jul. 26, 1997 [KR] Rep. of Korea ..... 97-35337

[51] Int. Cl.[6] ..... F25B 49/00; F25D 21/06

[52] U.S. Cl. ..... 62/151; 62/131; 62/186

[58] Field of Search ..... 62/186, 276, 282, 62/131, 151

[56] References Cited

U.S. PATENT DOCUMENTS 1,726,631 9/1929 Shipman .
4,732,010 3/1988 Linstromberg et al. ..... 62/187
5,191,774 3/1993 Park ..... 62/408
5,711,159 1/1998 Whipple et al. ..... 62/186 X
5,737,935 4/1998 Heo ..... 62/186

FOREIGN PATENT DOCUMENTS 0 590 536 4/1994 European Pat. Off. .
55-153574 4/1954 Japan .
59-36491 3/1984 Japan .
6-82144 3/1994 Japan .
8-504939 5/1996 Japan .

*Primary Examiner*—William Wayner
*Attorney, Agent, or Firm*—Burns, Doane, Swecker & Mathis, L.L.P.

[57] ABSTRACT

A refrigerator which has a device for opening/closing cool air discharge ports is disclosed. The device includes plates for opening/closing the ports, and a driving device for driving the plates. The heat exchange between an evaporator and the outside warm air is prevented during the defrosting operation when a door is open. Hence the cooling efficiency is enhanced and the frost caused by the outside warm air is not generated on the evaporater.

7 Claims, 6 Drawing Sheets

REFRIGERATOR CAPABLE OF PREVENTING HEAT EXCHANGE BETWEEN AN EVAPORATOR AND OUTSIDE WARM AIR

BACKGROUND OF THE INVENTION

1. Field of the Invention

The present invention relates to a refrigerator, and more particularly, to a refrigerator having a device for opening/closing cool air discharge ports during a defrosting operation and/or when a door is open.

2. Related Art

As shown in FIG. 1, a general refrigerator has a body 14 forming a freezing compartment 15 and a fresh food compartment 1, doors 16 and 12 for opening/closing the freezing compartment 15 and the fresh food compartment 1 respectively, a compressor 19 for compressing refrigerant, an evaporator 11 for generating cool air by evaporating the refrigerant supplied from the compressor 19, and a fan 20 for blowing the cool air generated by the evaporator 11.

A duct member 3 for forming a cool air duct 2 is installed at the rear part of the fresh food compartment 1. The duct member 3 has a plurality of cool air discharge ports 3*a* opened in the fresh food compartment 1. The cool air blown by the fan 20 flows into the cool air duct 2, and then is discharged into the fresh food compartment 1 through the cool air discharge ports 3*a*. In the cool air duct 2, a guide device 13 for guiding the cool air flowing into the cool air duct 2 toward the cool air discharge ports 3*a* is installed.

While the refrigerator operates, frost is generated on the evaporator 11. The cooling efficiency of the evaporator 11 is lowered by the frost. Hence, the refrigerator is equipped with a heater 17 for removing the frost, and performs defrosting operation by heating the evaporator 11 using the heater 17 when the refrigerator is used more than a predetermined period of time.

In such a conventional refrigerator, there is a problem that the heat generated by the heater 17 during the defrosting operation is transmitted into the fresh food compartment 1. The heat generated by the heater 17 is mainly transmitted through the same path with the path for supplying the cool air. That is, the heat is mainly transmitted to the fresh food compartment 1 through the cool air duct 2 and the cool air discharge ports 3*a*. Due to the heat transmitted to the fresh food compartment 1, the cooling efficiency of the fresh food compartment 1 is lowered, and the status of the food stored therein cannot be maintained properly.

Furthermore, when a user opens the door 12 of the fresh food compartment 1, the outside warm air flows into the fresh food compartment 1, which mainly flows into the area adjacent to the evaporator 11. When the outside air flows toward the evaporator 11, the frost is generated much more on the evaporator 11. Then, the defrosting operation should be performed more frequently. The heater 17 must be operated in order to perform the defrosting operation, so the cooling efficiency is still more lowered by the frequent defrosting.

SUMMARY OF THE INVENTION

The present invention has been proposed to overcome the above described problems in the prior art, and accordingly it is the object of the present invention to provide a refrigerator which can prevent the transmission of heat generated by a heater into a cooling compartment during the defrosting operation, and prevent the inflow of outside warm air toward an evaporator when the door is open.

To achieve the above object, the present invention provides a refrigerator comprising: a body for forming a cooling compartment; a door for opening/closing the cooling compartment; an evaporator for generating cool air to be supplied into the cooling compartment by evaporating refrigerant; a heater for removing frost generated on the evaporator; a duct member forming a cool air duct for guiding the cool air generated from the evaporator, the duct member being formed with a plurality of cool air discharge ports opened in the cooling compartment; and an opening/closing device including a driving motor being installed in the cool air duct, a cam member being rotated by the driving motor, a movement means being moved up and down by the cam member, and plates for opening/closing the cool air discharge ports according to an up-and-down movement of the movement means, the opening/closing device for opening/closing the cool air discharge ports during a defrosting operation and/or when the door is open.

The cam member is a cylinder formed with a cam groove on a periphery thereof.

According to a preferred embodiment of the present invention, the movement means comprises a lever having a guide pin inserted into the cam groove at one end thereof, the lever of which the other end is fixed with the plate, and a central part is fixed by a pivoting pin, the lever for pivoting the plate when the cam member is rotated.

Also, according to another embodiment of the present invention, the movement means comprises: a hollow cylinder for accommodating the cylinder, the hollow cylinder having a guide protrusion formed on an inner side thereof, the guide protrusion being inserted into the cam groove; and an operation rod being connected to the hollow cylinder. Here, the plate is hingedly mounted at an edge of the cool air discharge port, and support protrusions are protruded at a part of the operation rod. The support protrusions support the plates, so that the plates open the cool air discharge ports when the operation rod is moved down, and the plates close the cool air discharge ports when the operation rod is moved up.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
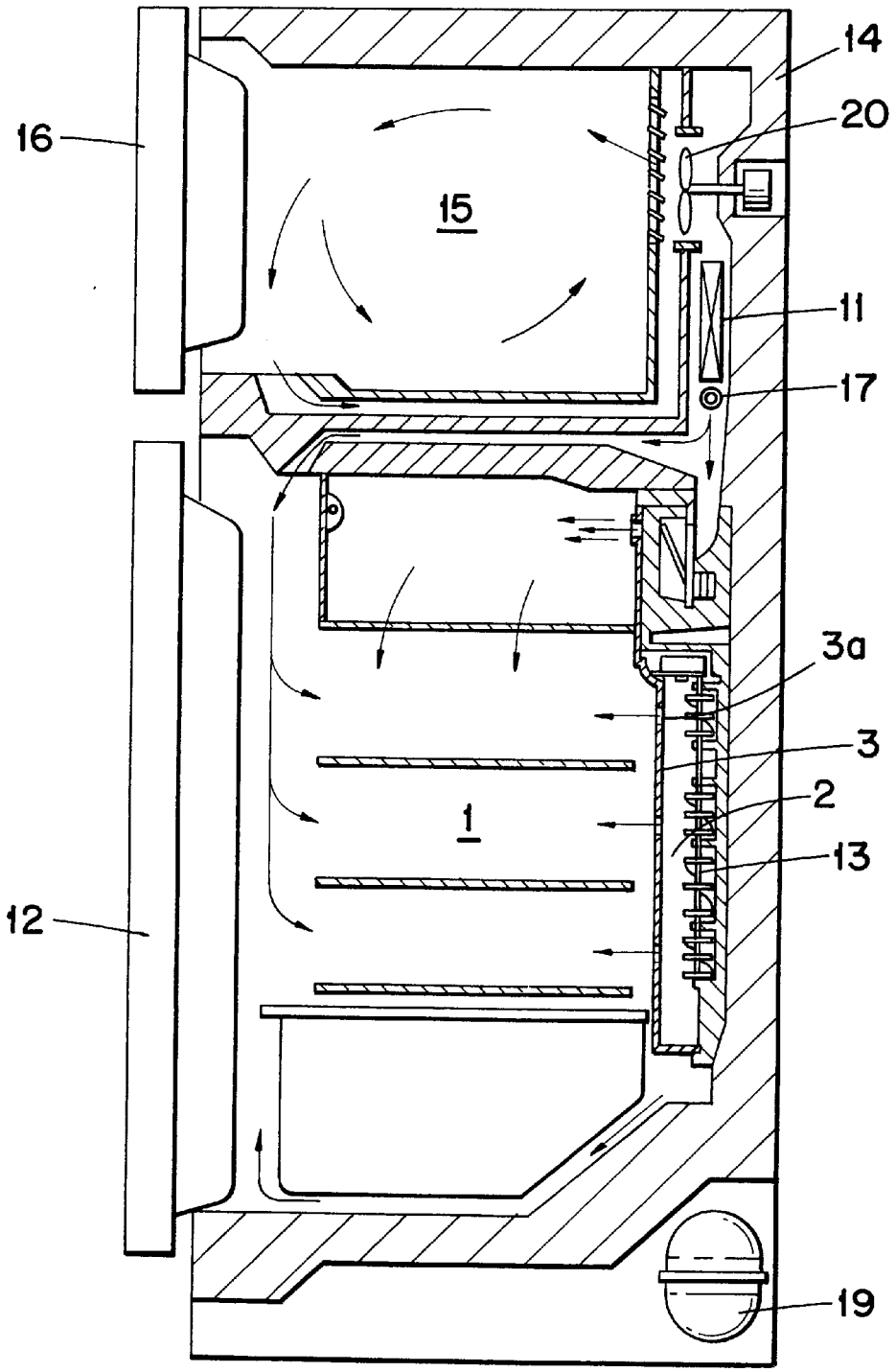
FIG. 1 (PRIOR ART)
FIG. 1 is a side sectional view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
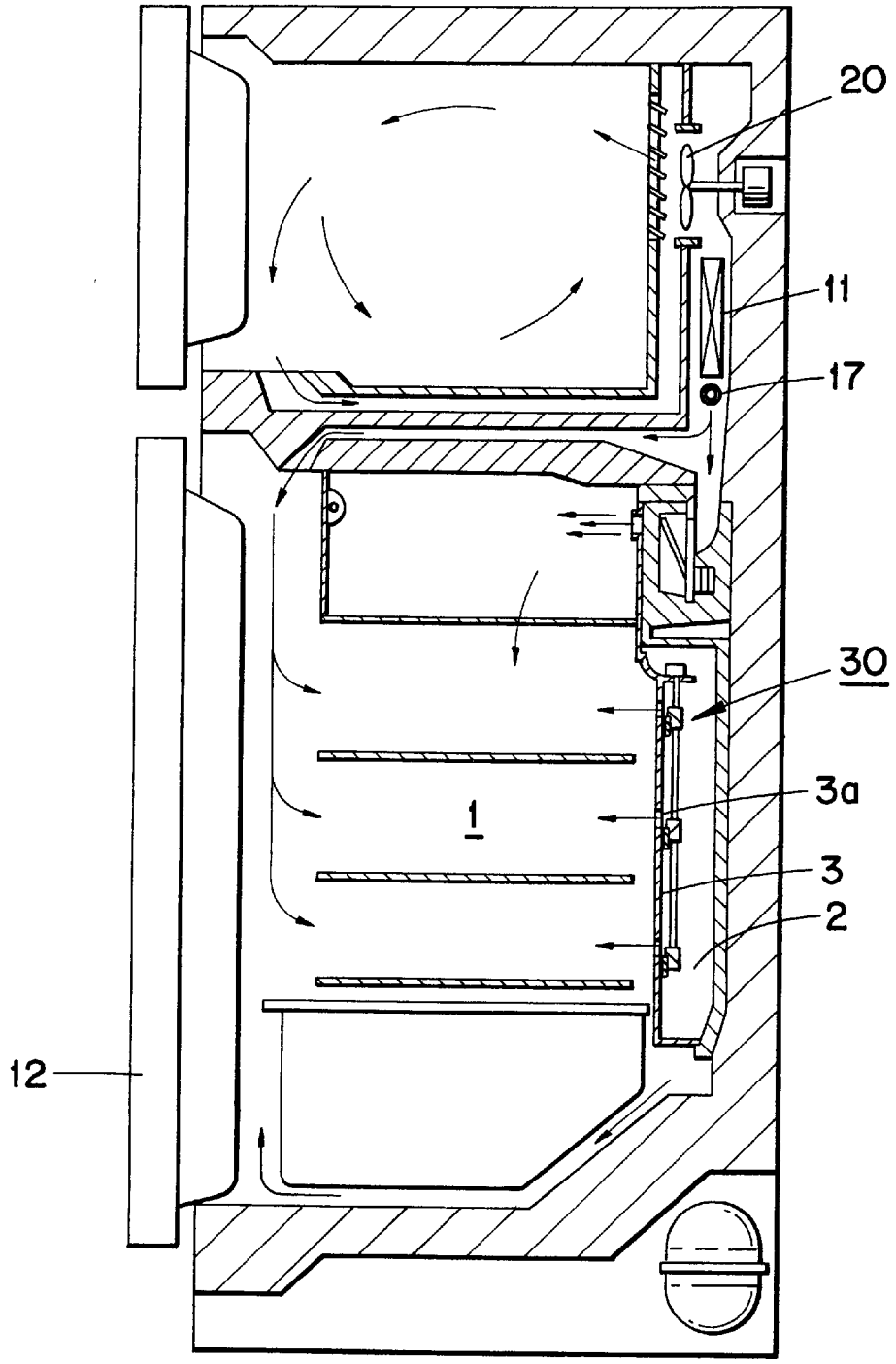
FIG. 2 is a side sectional view of a refrigerator according to the present invention.
Figure 3:
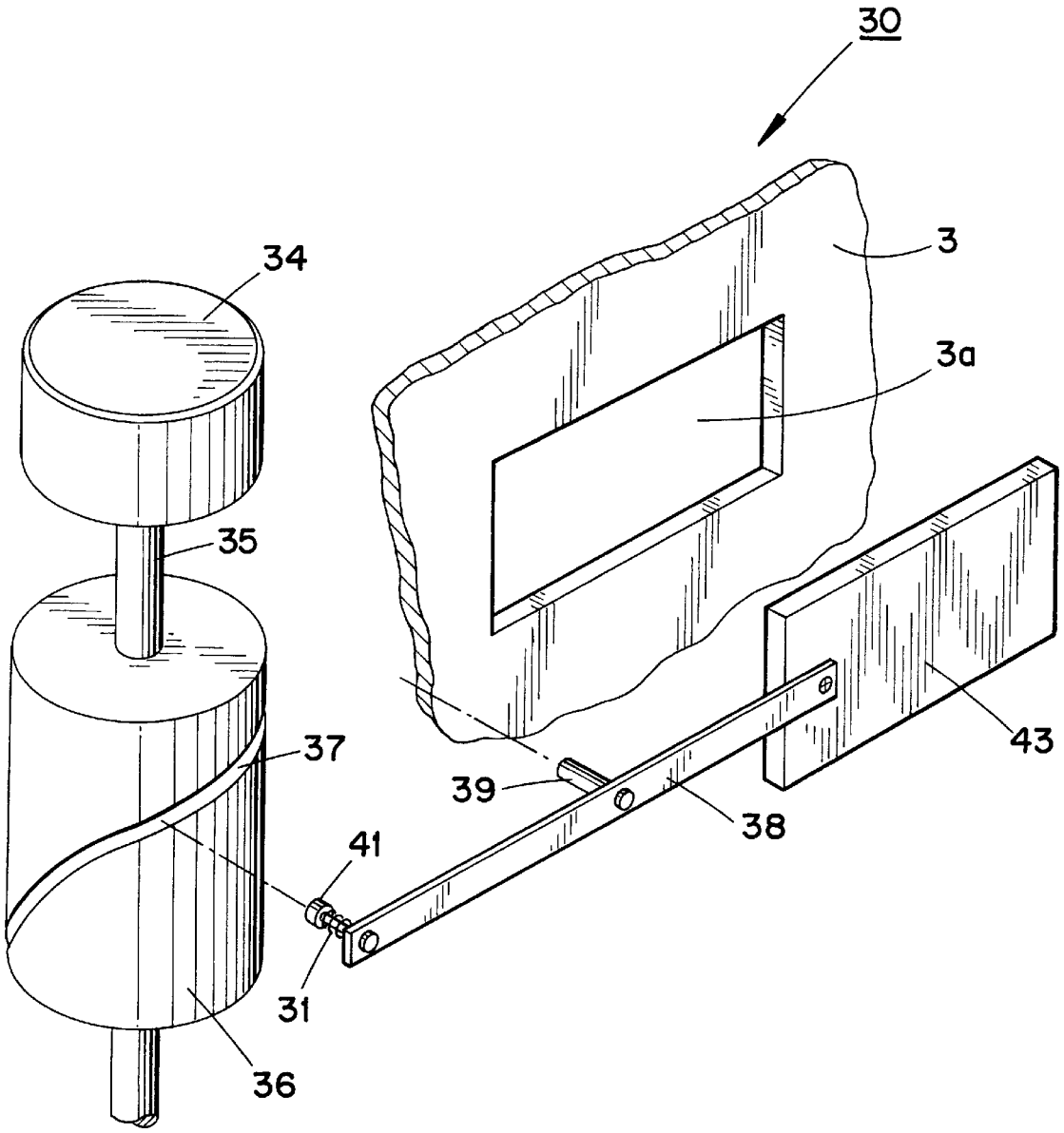
FIG. 3 is an enlarged perspective view of an opening/closing device shown in FIG. 2.
Figure 4:
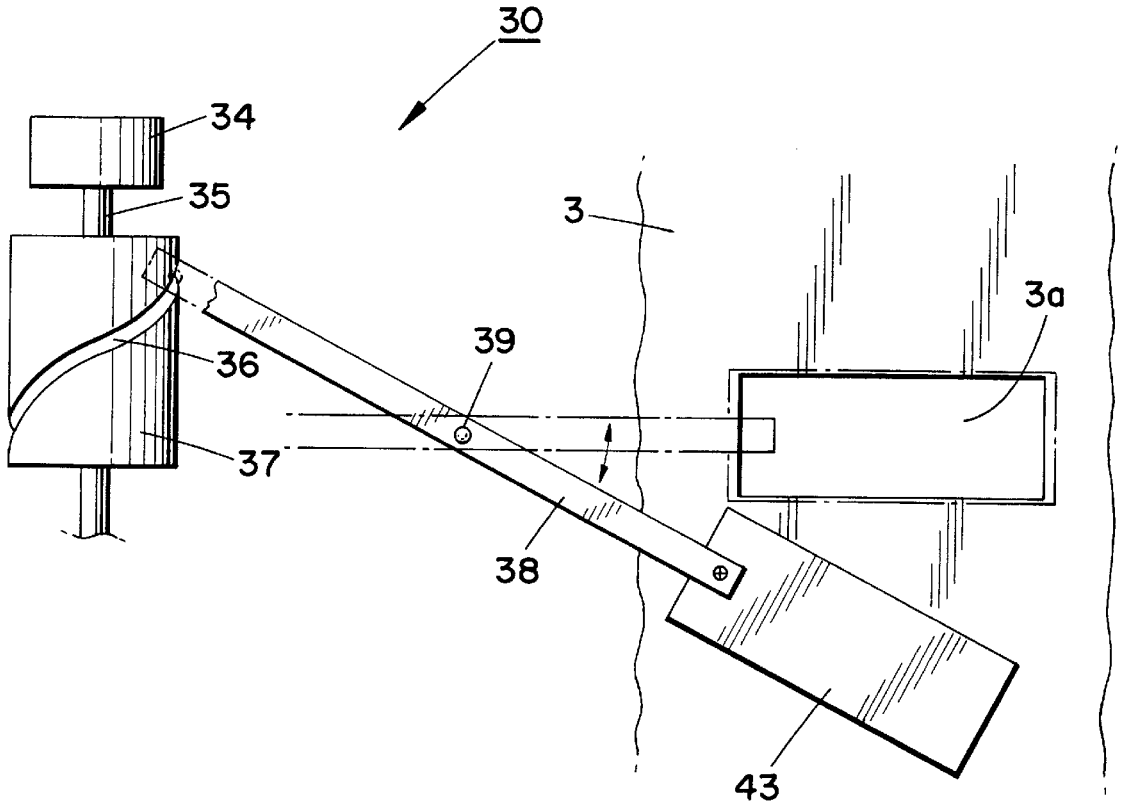
FIG. 4 is a side sectional view of FIG. 3.

FIG. 2 is a side sectional view of a refrigerator according to the present invention, and FIGS. 3 and 4 are enlarged views of an opening/closing device shown in FIG. 2. In the cool air duct 2, an opening/closing device 30 for opening/closing the cool air discharge ports 3*a* is installed.

The opening/closing device 30 includes a driving motor 34 installed in the cool air duct 2, a plurality of cam cylinders 36 being rotated by the driving motor 34, a plurality of levers 38 being driven by the cam cylinders 36 respectively, and a plurality of plates 43 being operated by the lever 38 respectively.

The cam cylinders 36 are connected to the rotational shaft 35 of the driving motor 34. Each of the cam cylinders 36 is formed with a cam groove 37 on the periphery thereof.

A guide pin 41 inserted into the cam groove 37 is installed at one end of the lever 38. The other end of the lever 38 is fixed with the plate 43. A pivoting pin 39 is installed at the central part of the lever 38. The pivoting pin 39 is fixed on the duct member 3, whereby the lever 38 is pivotably installed by the pivoting pin 39.

Between the lever 38 and the guide pin 41, a spring member 31 for forcing the guide pin 41 into the cam groove 37 is disposed. The guide pin 41 comes in elastic contact with the bottom of the cam groove 37, and thereby the operation of the lever 38 is efficiently guided by the cam cylinder 36.

While the refrigerator operates, the plates 43 keep the open state of the cool air discharge ports 31. When the defrosting operation of the refrigerator begins, the driving motor 34 is driven by a control part (not shown) to rotate the cam cylinders 36, whereby the levers 38 pivot. As the levers 38 pivots, the plates 43 close the cool air discharge ports 3*a*.

During the operation of the refrigerator, when a user opens the door 12, the opening of door 12 is sensed by a sensor for use in sensing the opening/closing of the door 12, and then the control part drives the driving motor 34 to close the cool air discharge ports 3*a* as described above.

Since the cool air discharge ports 3*a* are closed during the defrosting operation that the heater 17 generates heat and/or when the door 12 is open, the transmission of the heat from the heater 17 to the fresh food compartment 1 and the transmission of the outside warm air to the evaporator 11 are prevented. Therefore, the lowering of the cooling efficiency of the fresh food compartment 1 is prevented, and the frost caused by the outside warm air is not generated on the evaporator 11.

Figure 5:
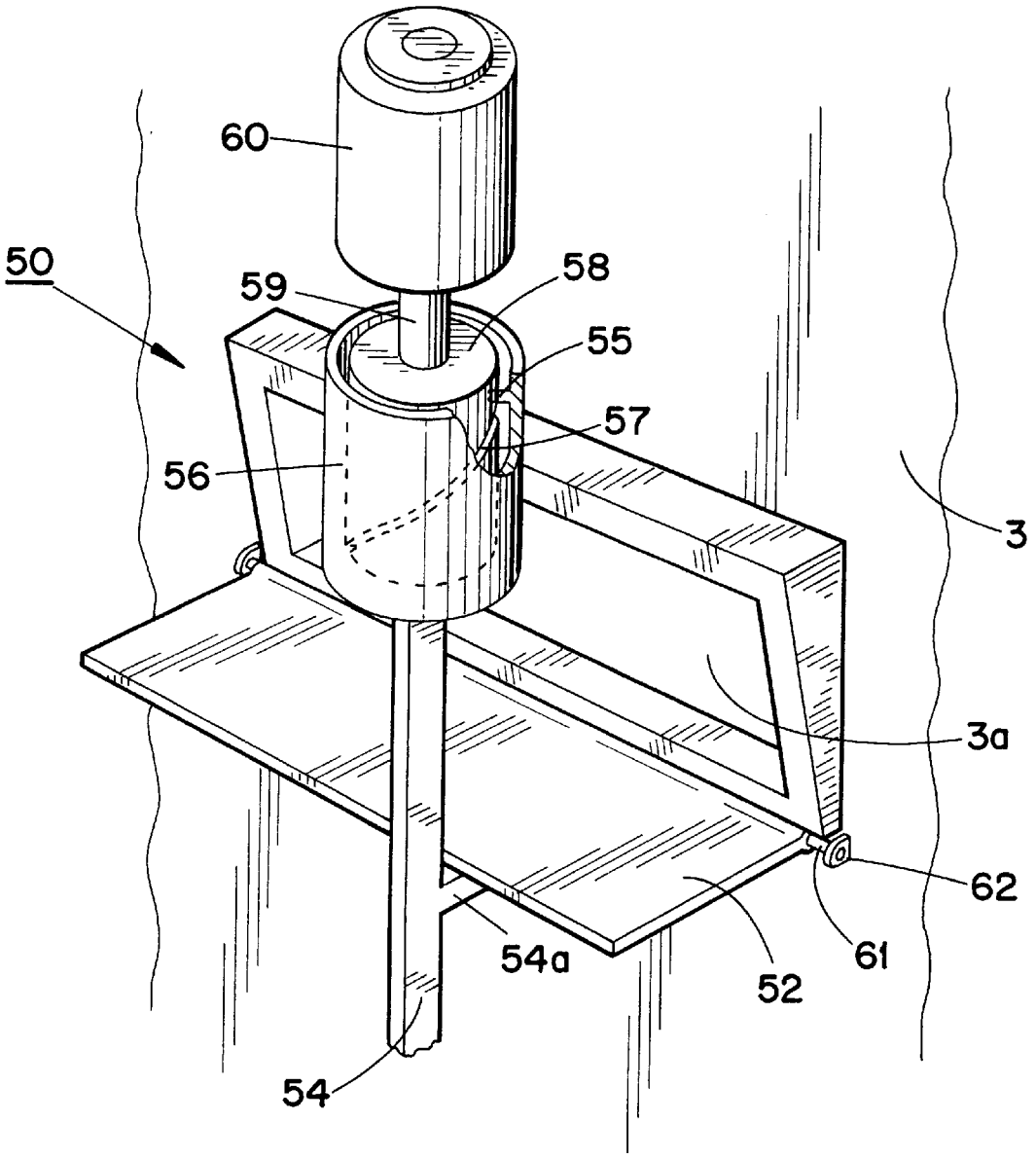
FIG. 5 is another embodiment of the opening/closing device according to the present invention.
Figure 6:
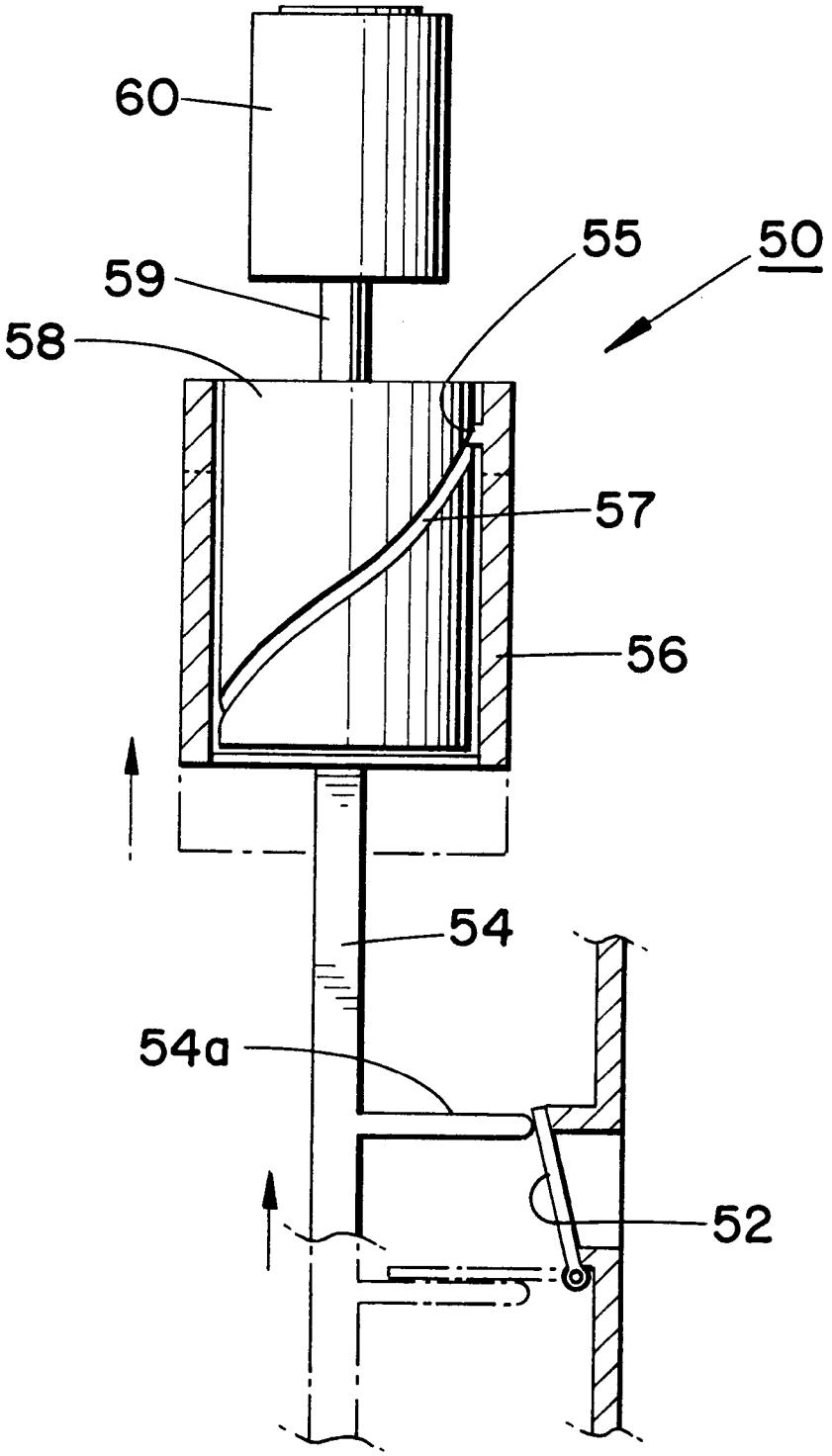
FIG. 6 is a side sectional view of FIG. 5.

FIG. 5 is another embodiment of the opening/closing according to the present invention, and FIG. 6 is a side sectional view of FIG. 5.

In the present embodiment, the opening/closing device 50 includes a driving motor 60 installed in the cool air duct 2, a cam cylinder 58 being rotated by the driving motor 60, a hollow cylinder 56 being driven by the cam cylinder 58, an operation rod 54 installed at the lower side of the hollow cylinder 56, and a plate 52 being operated by the operation rod 54.

The cam cylinder 58 is connected to the rotational shaft of the driving motor 60. A cam groove 57 is formed on the periphery of the cam cylinder 58.

The hollow cylinder 56 is formed to surround the outer side of the cam cylinder 58, and thereby the cam cylinder 58 is substantially accommodated in the hollow cylinder 56. At the inner side of the hollow cylinder 56, a guide protrusion 55 inserted into the cam groove 57 of the cam cylinder 58 protrudes.

The operation rod 54 is fixed by an additional fixing means which is not shown so that it is fixed in a rotational direction and can be moved in vertical direction.

Brackets 62 are formed at both ends of the lower edge of the cool air discharge port 3*a*, and a hinge pin 61 is fixed by the brackets 62. The plate 52 is hingedly mounted on the edge part of the cool air discharge port 3*a* by the hinge pin 61.

A support protrusion 54*a* protrudes at a part of the operation rod 54. The support protrusion 54*a* support the plate 52. The plate 52 is supported by the support protrusion 54*a* so that the cool air discharge port 3*a* is opened when the operation rod 54 is moved down as shown in FIG. 5, and the cool air discharge port 3*a* is closed when the operation rod 54 is moved up as shown in FIG. 6.

The operation of the refrigerator having the opening/closing device according to the present embodiment is similar to that of the embodiment shown in FIGS. 2 through 4. That is, when the door 12 is opened or the defrosting operation of the evaporator 11 is performed by the heater 17, the driving motor 60 is driven by the control part (not shown) to rotate the cam cylinder 58, and thereby the hollow cylinder 56 and the operation rod 54 move up. Therefore, the cool air discharge ports 3*a* are closed by the plates 52.

As described above, according to the present invention, since the heat exchange between the evaporator and the outside warm air is prevented during the defrosting operation and when the door is open, the cooling efficiency is enhanced and the frost caused by the outside warm air is not generated on the evaporated.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a body for forming a cooling compartment;

a door for opening/closing said cooling compartment;

an evaporator for generating cool air to be supplied into said cooling compartment by evaporating refrigerant;

a heater for removing frost generated on said evaporator;

a duct member forming a cool air duct for guiding the cool air generated from said evaporator, said duct member being formed with a plurality of cool air discharge ports opened in said cooling compartment; and an opening/closing device including a driving motor being installed in said cool air duct, a cam member being rotated by said driving motor, a movement means being moved up and down by said cam member, and plates for opening/closing the cool air discharge ports according to an up-and-down movement of said movement means, said opening/closing device constituting means for closing the cool air discharge ports during either or both of: a defrosting operation, and an opening of said door, and for maintaining such a closed state during the defrosting operation or the door being open.

2. The refrigerator as claimed in claim 1, wherein said cam member is a cylinder formed with a cam groove on a periphery thereof.

3. The refrigerator as claimed in claim 2, wherein said movement means comprises a lever having a guide pin inserted into the cam groove at one end thereof, said lever of which the other end is fixed with said plate, and a central part is fixed by a pivoting pin, said lever for pivoting said plate when said cam member is rotated.

4. The refrigerator as claimed in claim 3, further comprising a spring member disposed between said lever and said guide pin, said spring member for elastically forcing said guide pin into the cam groove.

5. The refrigerator as claimed in claim 2, wherein said movement means comprises:

a hollow cylinder for accommodating said cylinder, said hollow cylinder having a guide protrusion formed on an inner side thereof, said guide protrusion being inserted into the cam groove; and an operation rod being connected to said hollow cylinder.

6. The refrigerator as claimed in claim 5, wherein said plate is hingedly mounted at an edge of the cool air discharge port.

7. The refrigerator as claimed in claim 6, further comprising support protrusions being protruded at a part of said operation rod, said support protrusions for supporting said plates so that said plates open the cool air discharge ports when said operation rod is moved down, and said plates close the cool air discharge ports when said operation rod is moved up.

* * * * *